US007918517B2

(12) United States Patent
Chen et al.

(10) Patent No.: US 7,918,517 B2
(45) Date of Patent: Apr. 5, 2011

(54) LOCATING STRUCTURE FOR A SLIDE ASSEMBLY

(75) Inventors: Ken-Ching Chen, Kaohsiung Hsien (TW); Chien-Li Huang, Kaohsiung Hsien (TW); Wei-Sheng Wang, Kaohsiung Hsien (TW); Chun-Chiang Wang, Kaohsiung Hsien (TW)

(73) Assignee: King Slide Works Co., Ltd., Kaihsiung Hsien (TW)

( * ) Notice: Subject to any disclaimer, the term of this patent is extended or adjusted under 35 U.S.C. 154(b) by 593 days.

(21) Appl. No.: 11/907,413

(22) Filed: Oct. 12, 2007

(65) Prior Publication Data

US 2009/0096340 A1 Apr. 16, 2009

(51) Int. Cl.
*A47B 95/00* (2006.01)

(52) U.S. Cl. ..... 312/334.46

(58) Field of Classification Search ..... 312/333, 312/334.44, 334.46, 334.47, 334.8, 334.11, 312/334.1; 384/18, 20, 21
See application file for complete search history.

(56) References Cited

U.S. PATENT DOCUMENTS 4,549,773 A * 10/1985 Papp et al. ..... 384/18
6,367,899 B1 4/2002 Hwang et al.
6,375,290 B1 4/2002 Lin et al.
6,412,891 B1 7/2002 Liang et al.
6,585,337 B1 7/2003 Chen et al.
6,817,685 B2 11/2004 Lammens
6,851,774 B2 2/2005 Chen et al.
6,935,710 B2 8/2005 Chen et al.
6,945,619 B1 * 9/2005 Chen et al. ..... 312/334.47
7,101,081 B2 9/2006 Chen et al.
7,108,340 B2 * 9/2006 Lai ..... 312/334.46
7,571,968 B2 * 8/2009 Ji et al. ..... 312/333
2004/0174102 A1 * 9/2004 Chen et al. ..... 312/334.46

* cited by examiner

*Primary Examiner* — Darnell M Jayne
*Assistant Examiner* — Matthew W Ing
(74) *Attorney, Agent, or Firm* — Rosenberg, Klein & Lee

(57) ABSTRACT

A locating structure for a slide assembly includes a first track, a second track, a releasing member, and a locating member; a locating tab is provided at a front end of the first track; the second track is inserted and connected onto the first track to slide thereon; the second track is provided with a locating portion; the releasing member is mounted to an inner side of the second track; one end of the releasing member is provided with an operation button; the locating member is located on one side of the operation button and has a propped portion and a plunged portion; the locating member provides resilience for the propped portion to hold against the locating portion of the second track; and the locating member drives the propped portion to disengage from the locating portion by means of the plunged portion.

3 Claims, 11 Drawing Sheets

LOCATING STRUCTURE FOR A SLIDE ASSEMBLY

BACKGROUND OF THE INVENTION (a) Field of the Invention

The present invention relates to a locating structure for a slide assembly, and more particularly, to one that allows a transitional locating function to a releasing member without having to continue applying force by manual on the releasing member when the releasing member is operated to leave its home point.

(b) Description of the Prior Art

In a slide generally available in the market that is designed with comparatively stronger function, it provides a locating function by preventing a mobile track from being reduced when the mobile track is pulled out and at its extended status; furthermore, to make sure that the mobile track will not be completely disengaged from a fixed track when the mobile track is pulled out of the fixed track, a locking structure is provided to prevent the mobile track from falling off the fixed track. The mobile track may be designed as retractable and the locking structure to prevent falling off will be provided with a releasing member to unlock.

An object, e.g., a drawer, usually mounted with slide uses a set of slides. That is on both left and right sides of the drawer are respectively mounted with two slides. When each slide is provided a mechanism to prevent reduction or falling off and a user desiring to operate a releasing member to unlock has to use both hands to operate two releasing members of slides on both sides at the same time and to continue applying force on the releasing member before either pushing in or pulling out the mobile tracks at the same time.

However, when more than two slides are used to a drawer, it will become very difficult for a user to have both hands attempting to operate multiple releasing members at the same time for synchronous unlocking.

SUMMARY OF THE INVENTION

The primary purpose of the present invention is to provide a locating structure for a slide assembly to solve the problem of requiring continuous apply force to push or pull multiple slides at the same time to unlock. The principle technical means is to allow a transitional locating function for a releasing member without having to continuously apply force by manual on the releasing member when operated to leave its home point.

To achieve the purpose, a locating structure for a slide assembly comprising:

a first track;

a second track inserted and connected onto the first track to slide thereon, the second track being provided with a locating portion;

a releasing member mounted to an inner side of the second track and having one end provided with an operation button; and a locating member located on one side of the operation button, the locating member having a propped portion and a plunged portion and providing resilience for the propped portion to hold against the locating portion of the second track.

Preferably, the locating portion of the second track is disposed in a slot of the second track; and the locating portion has at least one resisting surface.

Preferably, an indention is formed on one side of the operation button; and the locating member is disposed at the indention.

Preferably, the locating member is resilient and provided with a fixed end; a joint channel is provided on one side of the indention of the operation button; and the locating member has the fixed end to be inserted into the joint channel of the operation button to extend on the indention.

Preferably, the locating member and the operation button are made integrated with each other; and the locating member is resilient to be extended and placed on the indention.

Preferably, the locating member is pivotally connected to the operation button; and the locating member is provided with a resilient member to act on the locating member.

Preferably, the locating member is connected to the indention of the operation button for the locating member to engage in straight movement at the indention; and the locating member is provided with a resilient member to act on the locating member.

Preferably, two blocks are respectively provided on both sides of the locating member; two flanges are respectively provided on both sides of the indention of the operation button; and the blocks hold against the flanges.

Preferably, the locating member is formed with a trough; and the operation button is provided with a post inserting into the trough.

Preferably, the locating member is disposed on the releasing member.

Preferably, one end of the releasing member is provided with a handle portion; one end of the locating member is provided with an extension plate for the locating member to connect the handle portion by means of the extension plate; the operation button is fixedly connected to the handle portion of the releasing member; and a channel is disposed on the handle portion to permit penetration and placement by the locating member.

When compared to the prior art, the present invention provides the following advantages:

a. The releasing member is given a transitional locating function; each slide may be kept in its transitional unlocking status when the releasing member is pushed or pulled without having to operate all slides by manual at the same time so to allow a single user to easily unlock a drawer or similar object mounted with multiple slides.

b. The transitional locating function of the releasing member is automatically cleared off upon slides are retrieved without having to clear off the transitional locating function one by one by manual; meanwhile, when the slide is pulled or pushed once again, the associate locking mechanism connected to the releasing member has already returned to its locked up status thus to maintain providing the function of preventing reduction or falling off.

DETAILED DESCRIPTION OF THE PREFERRED EMBODIMENTS

Figure 1:
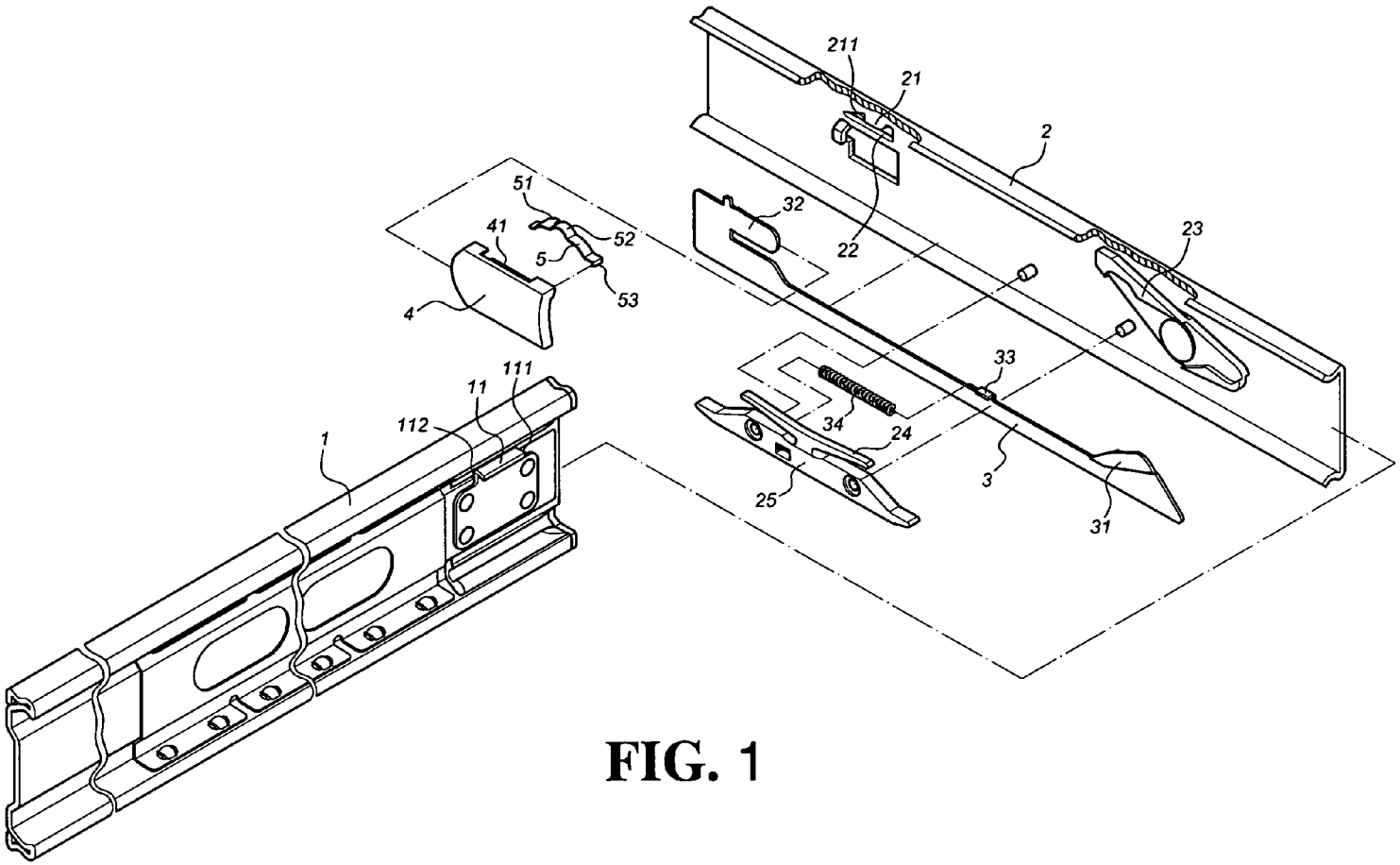
FIG. 1 is an exploded view showing a first preferred embodiment of the present invention containing an overall configuration of a first track and a second track.

Referring to FIG. 1, a first preferred embodiment of the present invention comprises a first track (1), a second track (2), a releasing member (3), an operation button (4), and a locating member (5).

A locating tab (11) is provided at a front end of the first track (1). The locating tab (11) has a first end (111) and a second end (112) at front and rear ends thereof.

The second track (2) connected to and sliding against the first track (1) is provided with a locating portion (21). The locating portion (21) in the first preferred embodiment is disposed in a slot (22) of the second track (2). The locating portion (21) has at least one resisting surface (211). A retaining member (23) is pivotally connected to the second track (2) to cope with the function of preventing the second track (2) from falling off the first track (1). The retaining member (23) in conjunction with a first resilient member (24) applies elasticity. The second track (2) is provided with a covering seat (25). The first resilient member (24) may be a stick shaped resilient lever that is connected to the covering seat (25). It is to be noted that the function of preventing from falling off by the retaining member (23) is a feature of the first preferred embodiment, not a patentable characteristic of the present invention.

Figure 2:
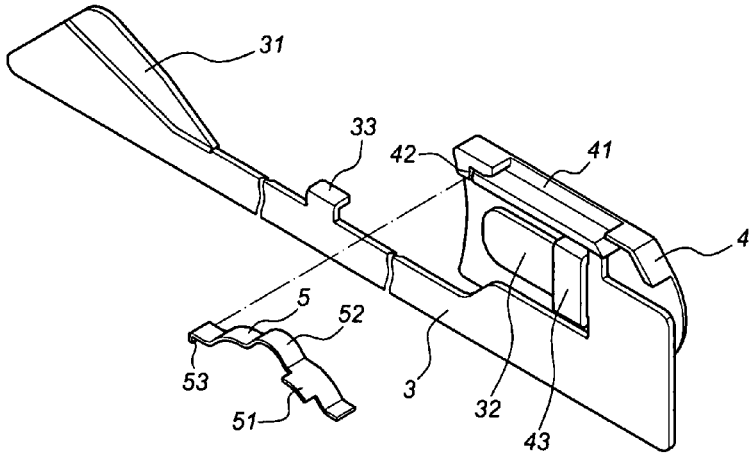
FIG. 2 is a schematic view showing a construction of the first preferred embodiment containing a releasing member, an operation button, and a locating member.
Figure 3:
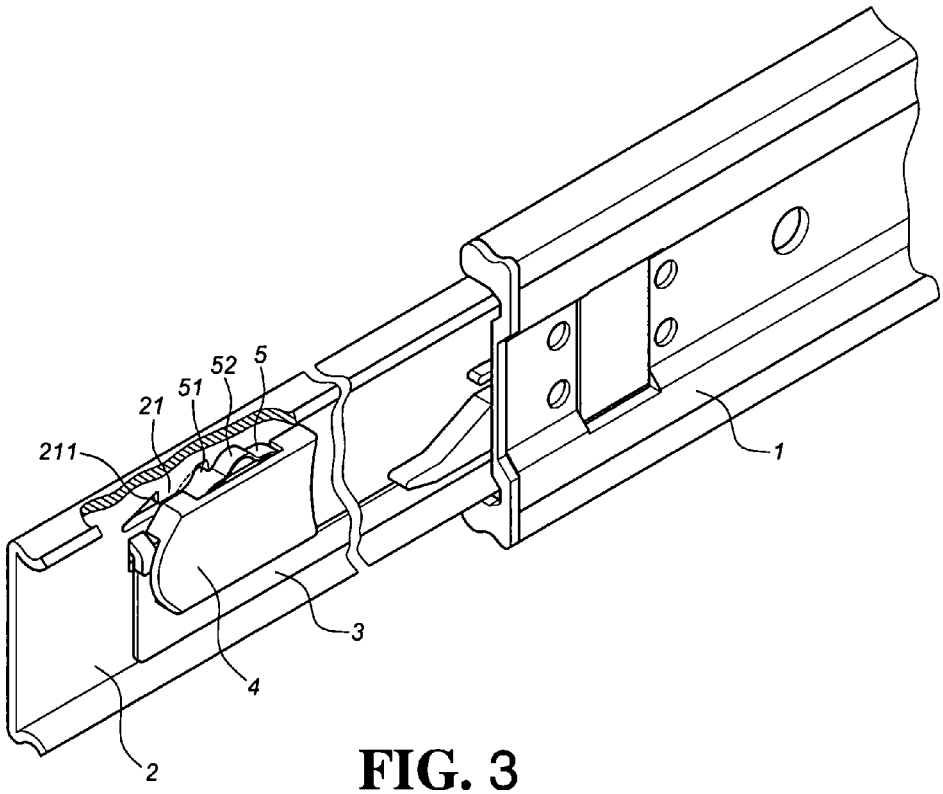
FIG. 3 is a schematic view showing an assembly of the first preferred embodiment of the present invention containing the releasing member, the operation button, and the locating member combined to the second track.

As also illustrated in FIGS. 2 and 3, the releasing member (3) is mounted to an inner side of the second track (2); and one of both relatively external ends of the releasing member (3) is provided with a releasing portion (31) and the other end is provided with an insertion portion (32) to be connected by the operation button (4). The releasing portion (31) in the first preferred embodiment is linked to the corresponding retaining member (23) for movement; and a second resilient member (34) is provided to function on the releasing member (3). The releasing member (3) is provided with a connection tab (33) to hold against one end of the second resilient member (34). In the first preferred embodiment, the second resilient member (34) is disposed inside the covering seat (25) so to allow the releasing member (3) to provide a force for it to automatically return to its home point by means of the second resilient member (34).

An indention (41) is formed on one side of the operation button (4). A joint channel (42) is provided on one side of the indention (41). The operation button (4) is provided with an insertion ring (43) for insertion of the insertion portion (32) of the releasing member (3).

The locating member (5) is a mobile part disposed at the indention (41) of the operation button (4), and has a propped portion (51) and a plunged portion (52). In the first preferred embodiment, the locating member (5) is a stick shaped resilient object and is provided with a fixed end (53) to insert the locating member (5) into the joint channel (42) of the operation button (4) to extend to where the indention (41) is located.

Figure 4:
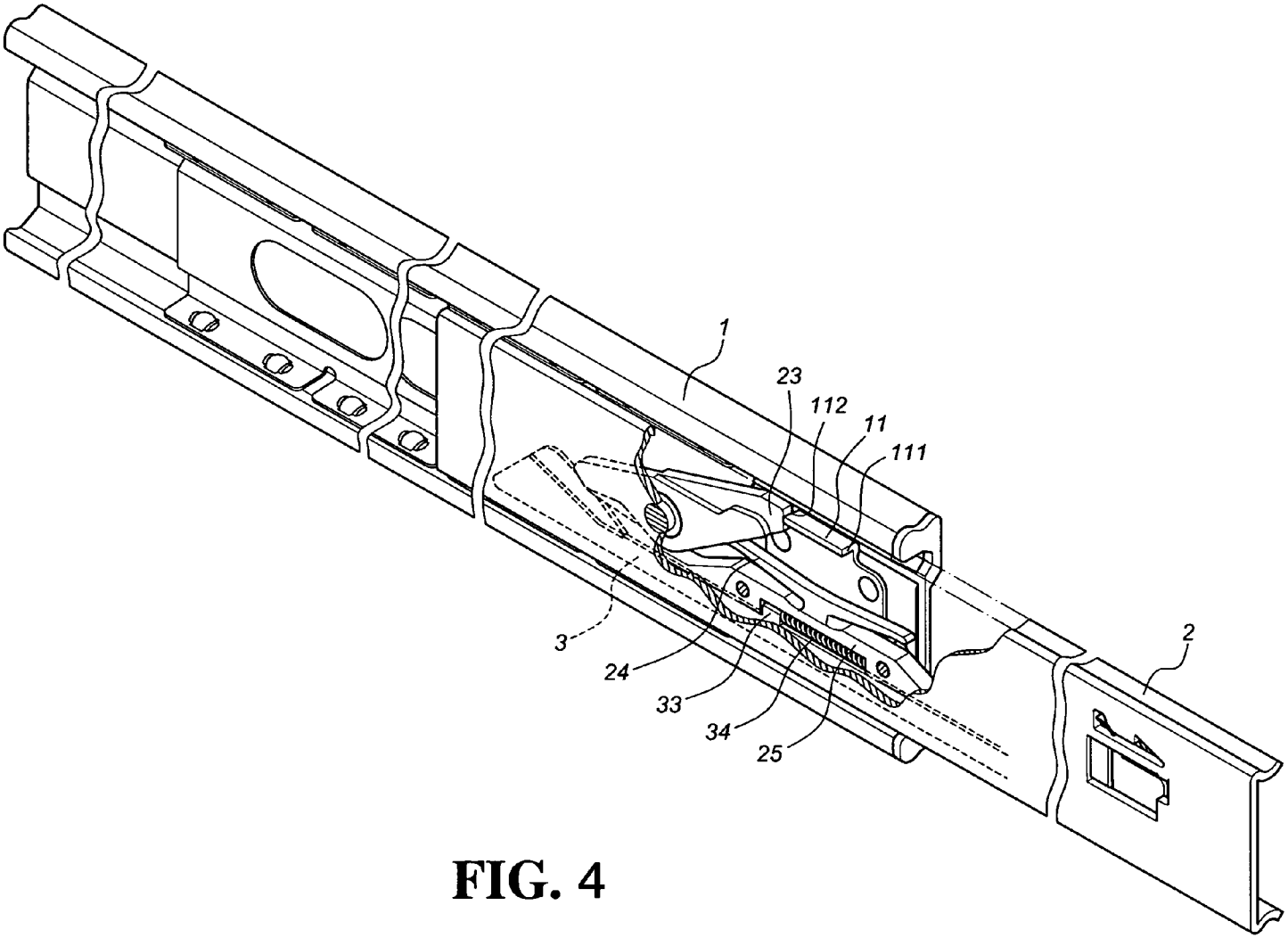
FIG. 4 is a schematic view showing that the second track is pulled out in relation to the first track to the extreme in the first preferred embodiment of the present invention, with the second track holding against a locating tab of the first track by means of a retaining member.

Accordingly, the second track (2) is inserted and connected to the first track (1) and then pulled out to slide to its extreme as illustrated in FIG. 4, the second track (2) has the retaining member (23) to hold against the second end (112) of the locating tab (11) of the first track (1) so to keep the second track (2) from being disengaged from the first track (1).

Figure 5:
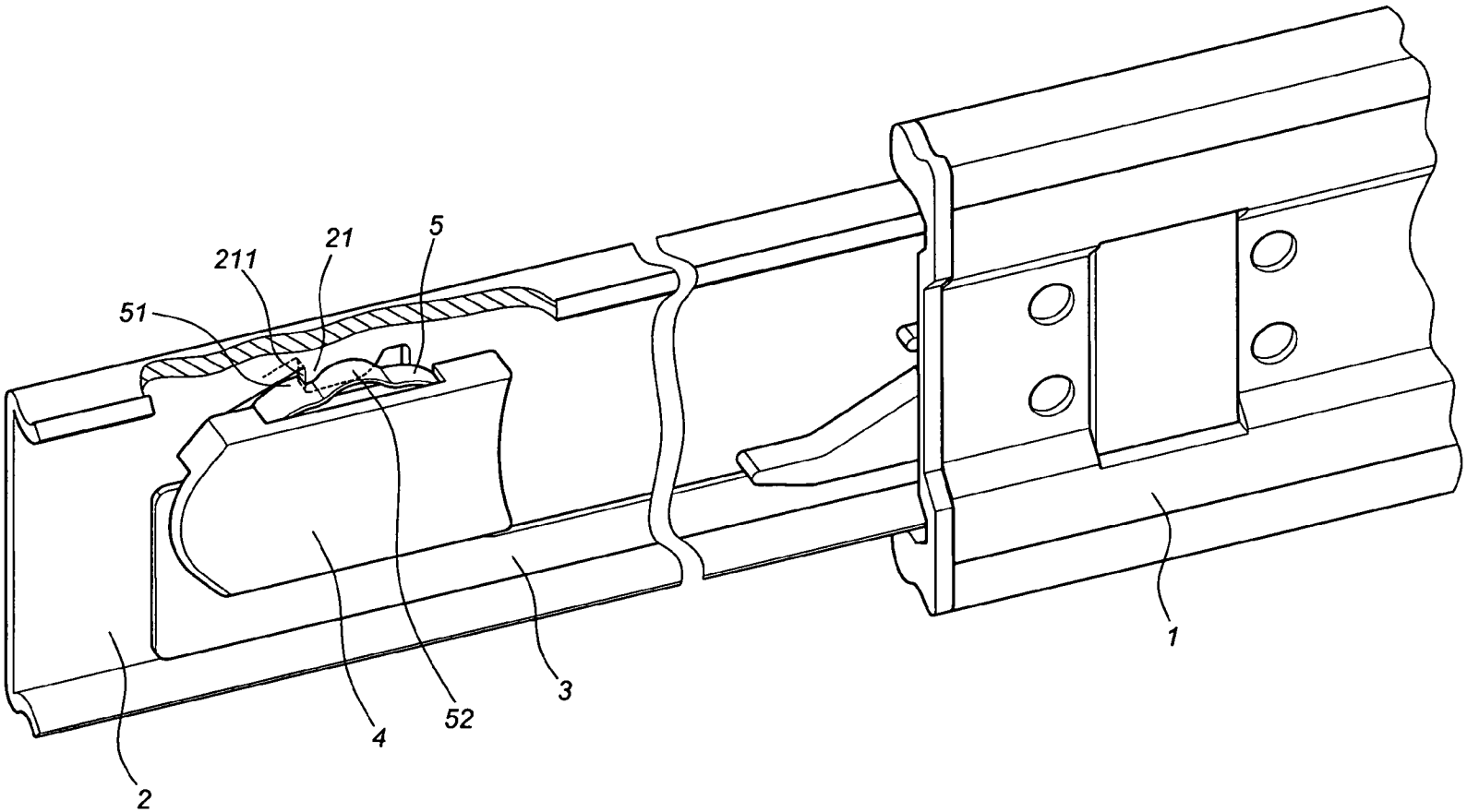
FIG. 5 is a schematic view showing that the first preferred embodiment of the present invention containing the releasing member, the operation button, and the locating member is pulled out, with a propped portion of the locating member holding against a locating portion.

As illustrated in FIG. 5, when the releasing member (3) is pulled, the locating member (5) linked to the operation button (4) slides by containing the locating portion (21) of the second track (2) for the propped portion (51) of the locating member (5) to hold against the resisting surface (211) of the locating portion (21) while having the operation button (4) and the releasing member (3) are temporarily located at a second point after having left a home point, and the second point in the first preferred embodiment is where may cause the second track (2) to be disengaged from the first track (1).

Figure 6:
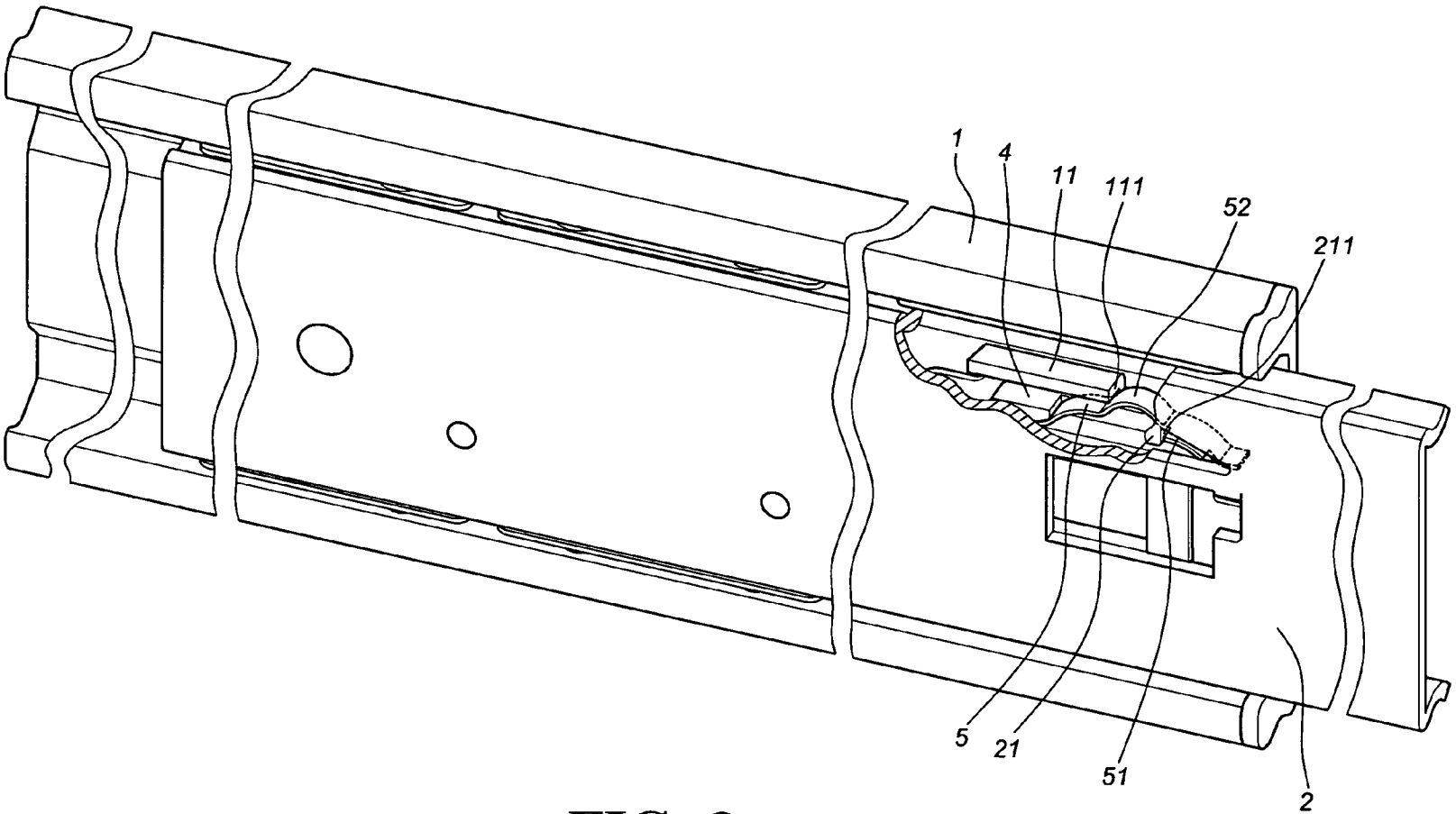
FIG. 6 is a schematic view showing that the second track is pushed into the first track in the first preferred embodiment of the present invention, with a plunged portion of the locating member reaching a first end of the locating tab.
Figure 7:
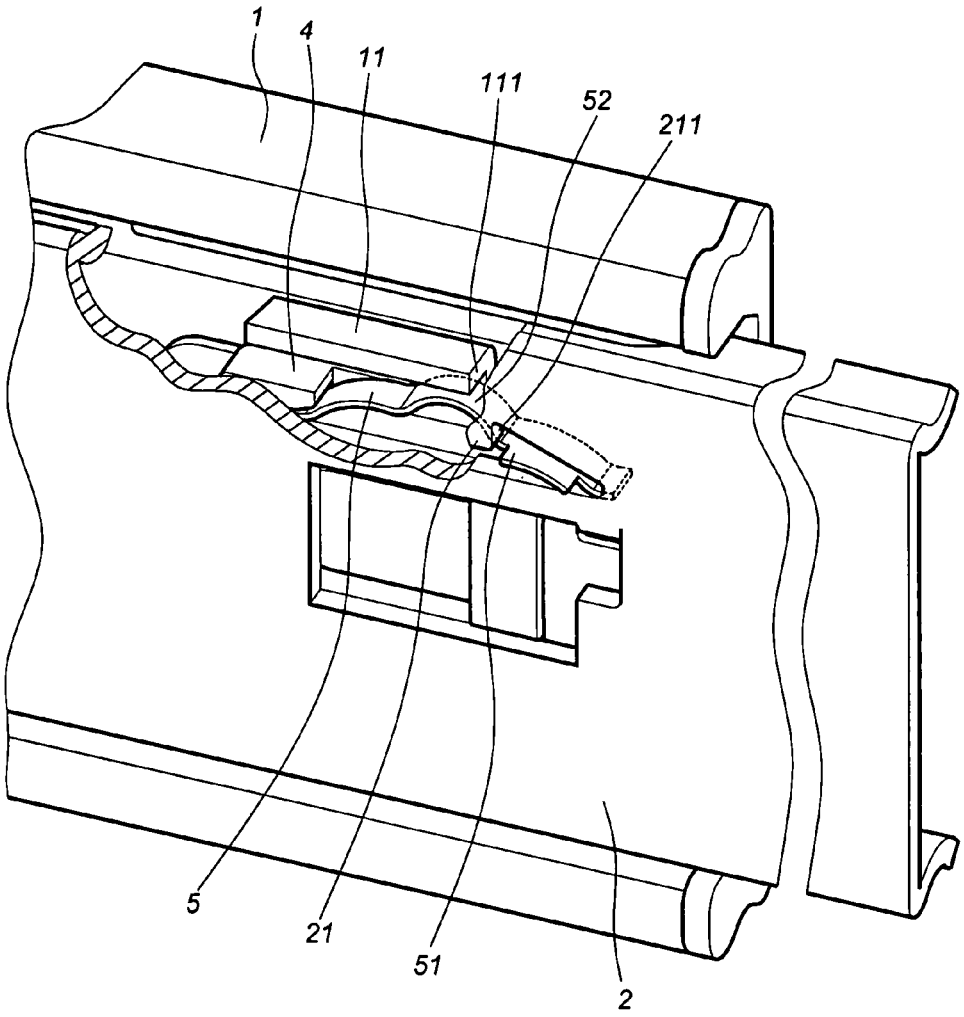
FIG. 7 is a schematic view showing that the second track is further pushed into the first trace in the first preferred embodiment of the present invention, with the plunged portion of the locating member being compressed by the locating tab and the propped portion of the locating member being disengaged from the locating portion.

As illustrated in FIG. 6, when the second track (2) is relatively retracted into the first track (1) once again, the second track (2) contacts the first end (111) of the locating tab (11) by means of the plunged portion (52) of the locating member (5); and as the second track (2) travels as illustrated in FIG. 7, the plunged portion (52) of the locating member (5) descends when gradually compressed by the locating tab (11) starting from the first end (111) thus to merely disengage the propped portion (51) of the locating member (5) from the resisting surface (211) of the locating portion (21). Accordingly, the releasing member (3) automatically returns to its home point and the retaining member (23) also returns to a status of preventing from falling off that corresponds to be held against by the locating tab (11) of the first track (1).

Figure 8:
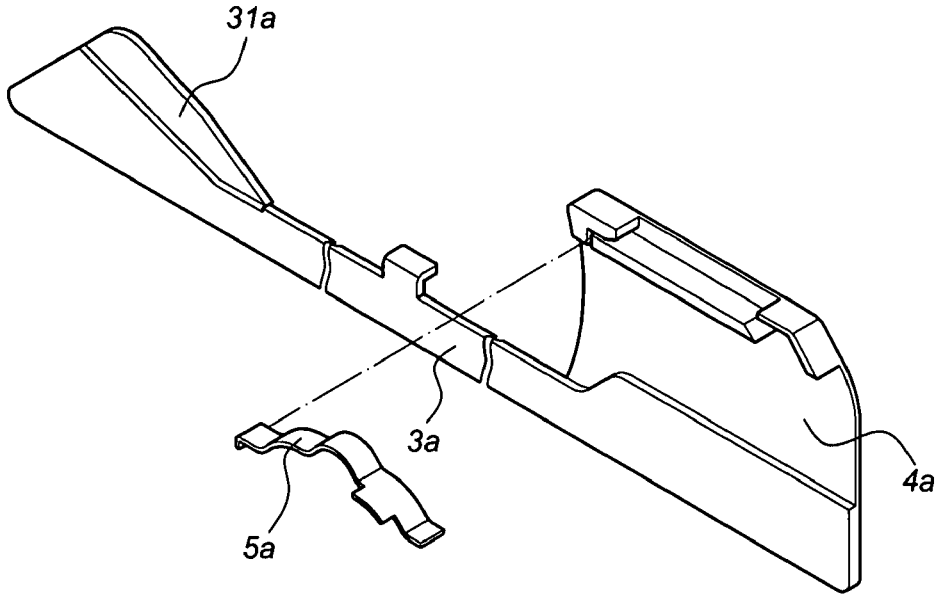
FIG. 8 is a schematic view showing a construction of a second preferred embodiment of the present invention.

As illustrated in FIG. 8 for a second preferred embodiment of the present invention, one end of both relatively external ends of a releasing member (3*a*) is provided with a releasing portion (31*a*) and another end is integrally formed with an operation button (4*a*) while a locating member (5*a*) and the operation button (4*a*) are inserted to each other.

Figure 9:
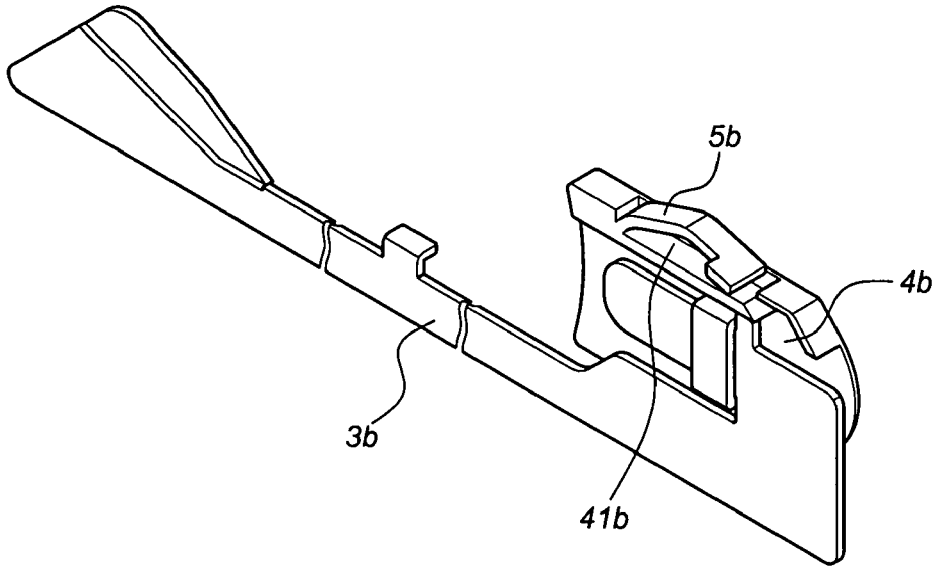
FIG. 9 is a schematic view showing a construction of a third preferred embodiment of the present invention.

As illustrated in FIG. 9 for a third preferred embodiment of the present invention, a locating member (5*b*) is integrally formed with an operation button (4*b*) while the locating member (5*b*) is provided with resilience and extends to be placed at an indention (41*b*) of the operation button (4*b*).

Figure 10:
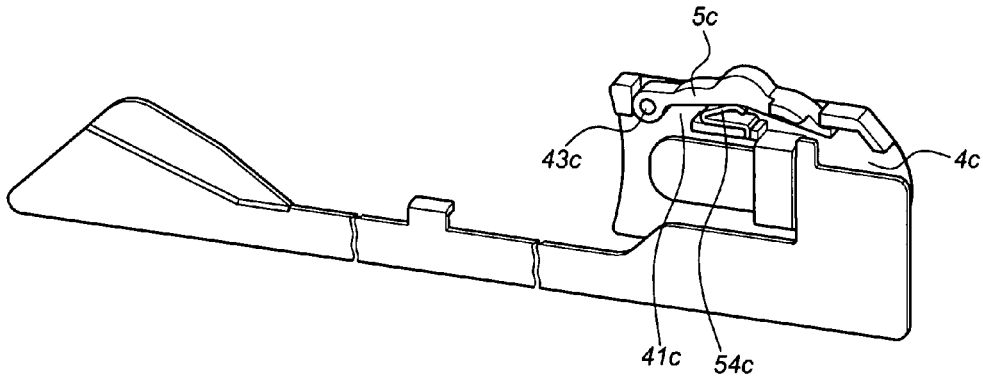
FIG. 10 is a schematic view showing a construction of a fourth preferred embodiment of the present invention.
Figure 11:
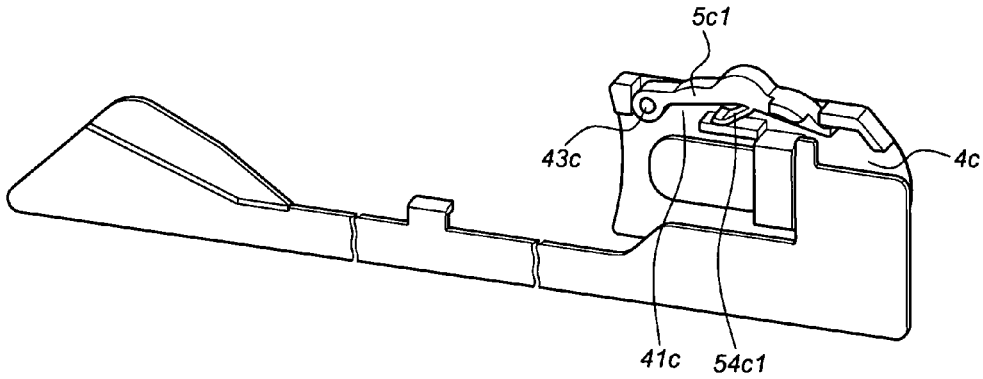
FIG. 11 is a schematic view showing a construction of a changed form of a resilient member in the fourth preferred embodiment of the present invention.
Figure 12:
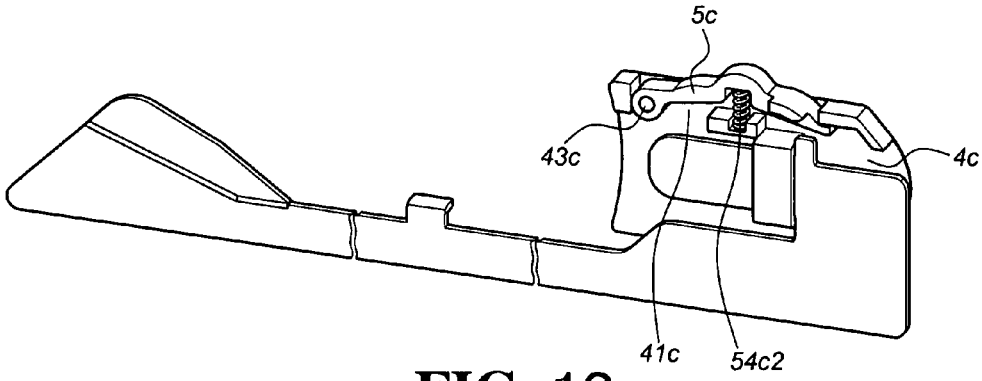
FIG. 12 is a schematic view showing a construction of another changed form of the resilient member in the fourth preferred embodiment of the present invention.

A locating member (5*c*) is pivotally connected to a pivot (43C) of an operation button (4*c*), as illustrated in FIG. 10 for a fourth preferred embodiment of the present invention, so that the locating member (5*c*) is placed at an indention (41*c*) of the operation button (4*c*). A resilient member (54*c*) is provided to act on the locating member (5*c*). In this preferred embodiment, the resilient member (54*c*) is a curved leaf spring. As illustrated in FIG. 11, a resilient member (54*c*1) may be a resilient leg extending from a locating member (5*c*1); or as illustrated in FIG. 12, the resilient member (54*c*2) is a spring.

Figure 13:
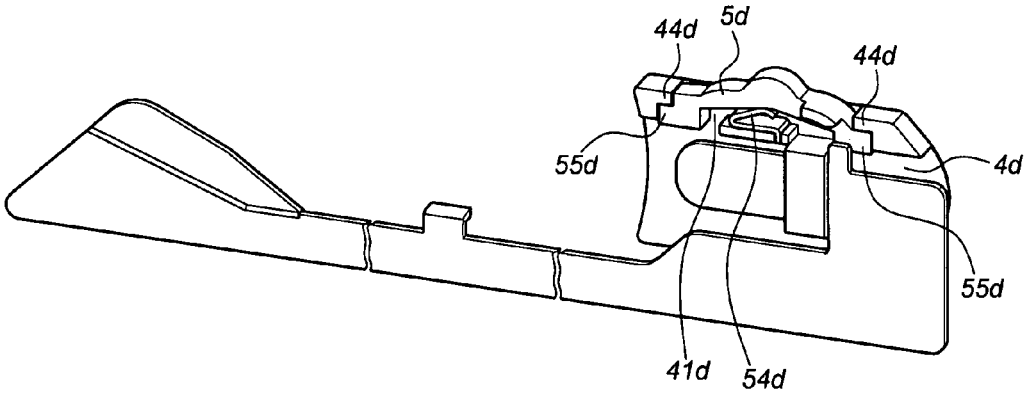
FIG. 13 is a schematic view showing a construction of a fifth preferred embodiment of the present invention.
Figure 14:
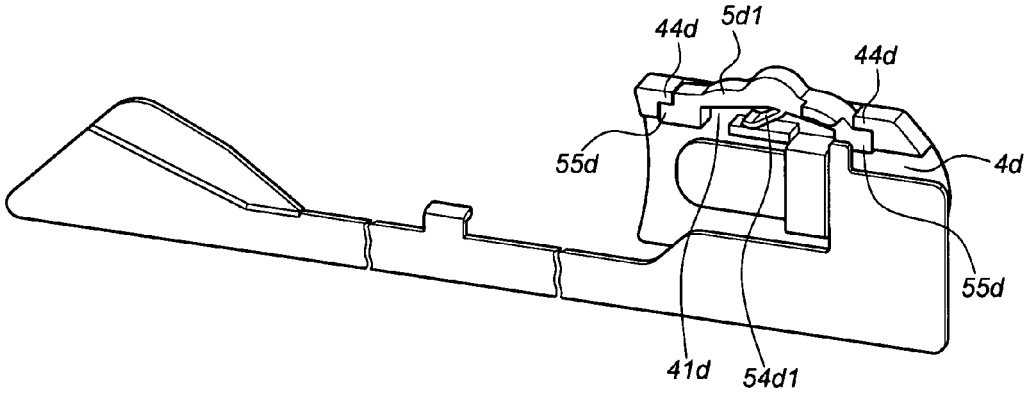
FIG. 14 is a schematic view showing a construction of a changed form of a resilient member in the fifth preferred embodiment of the present invention.
Figure 15:
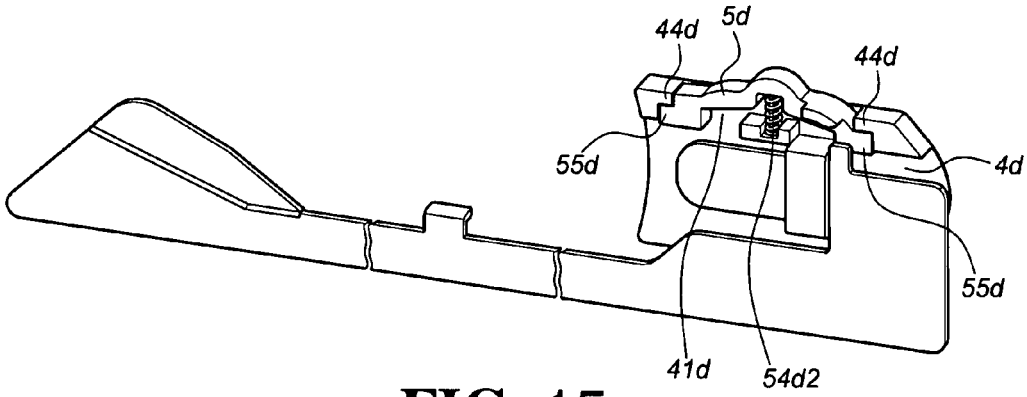
FIG. 15 is a schematic view showing a construction of another changed form of the resilient member in the fifth preferred embodiment of the present invention.

As illustrated in FIG. 13 for a fifth preferred embodiment of the present invention, a locating member (5*d*) is disposed at an indention (41*d*) of an operation button (4*d*) to slide for the locating member (5*d*) to engage in straight movement at the indention (41*d*) of the operation button (4*d*), and a resilient member (54*d*) is provided to act on the locating member (5*d*). Each of both sides of the locating member (5*d*) is provided with a block (55*d*); both sides of the indention (41*d*) of the operation button (4*d*) are respectively provided with a flange (44*d*); and a slide travel of the locating member (5*d*) is limited by having both blocks (55*d*) and their corresponding flanges (44*d*) to hold against one another. The resilient member (54*d*) is a curved leaf spring. As illustrated in FIG. 14, a resilient member (54*d*1) is a resilient leg extending from a locating member (5*d*1); or as illustrated in FIG. 15, the resilient member (54*d*2) is a spring.

Figure 16:
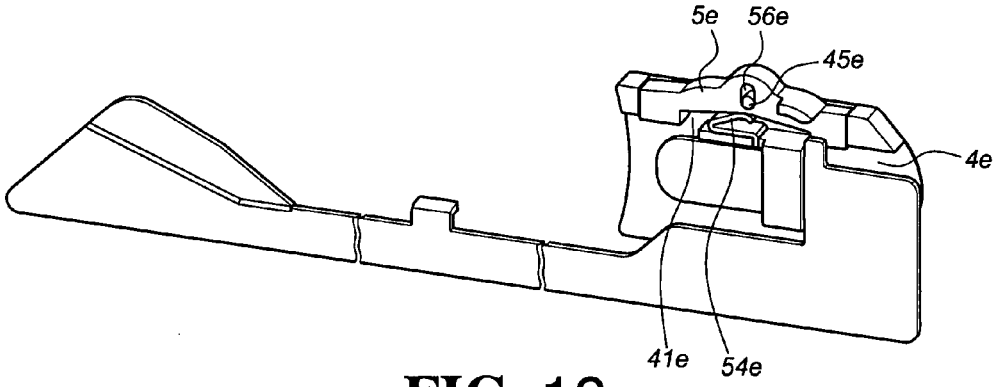
FIG. 16 is a schematic view showing a construction of a sixth preferred embodiment of the present invention.
Figure 17:
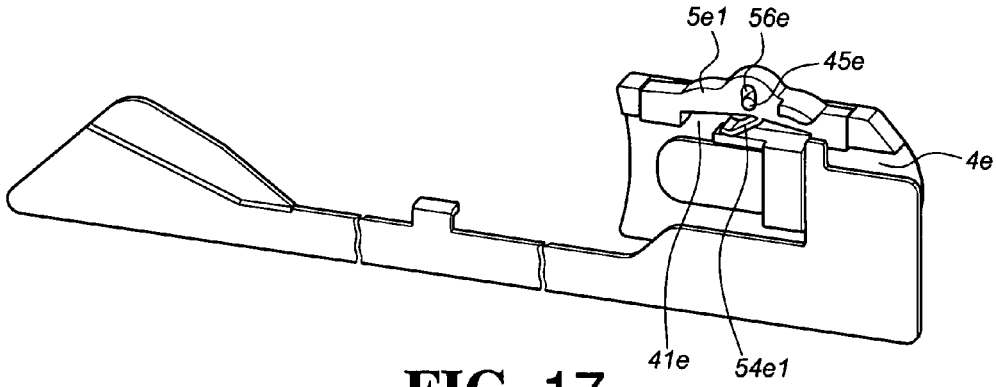
FIG. 17 is a schematic view showing a construction of a changed form of a resilient member in the sixth preferred embodiment of the present invention.
Figure 18:
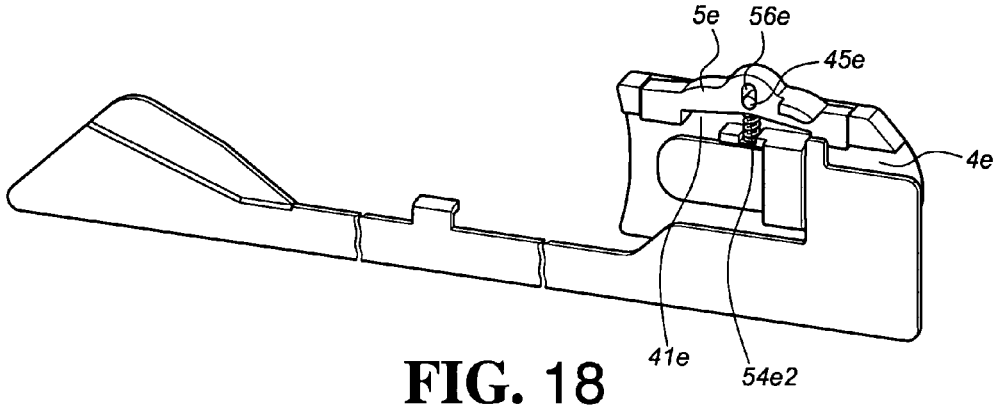
FIG. 18 is a schematic view showing a construction of another changed form of the resilient member in the sixth preferred embodiment of the present invention.

As illustrated in FIG. 16 for a sixth preferred embodiment of the present invention, a locating member (5*e*) is disposed at an indention (41*e*) of an operation button (4*e*) to slide so that the locating member (5*e*) is capable of executing straight movement at the indention (41*e*) of the operation button (4*e*). A resilient member (54*e*) is provided to act on the locating member (5*e*). The locating member (5*e*) is formed with a trough (56*e*), and the operation button (4*e*) is provided with a post (45*e*) inserting into the trough (45*e*) to limit slide travel of the locating member (5*e*). The resilient member (54*e*) is a curved leaf spring. As illustrated in FIG. 17, a resilient member (54*e*1) is a resilient leg extending from a locating member (5*e*1) or a resilient member (54*e*2) is a spring as illustrated in FIG. 18.

Figure 19:
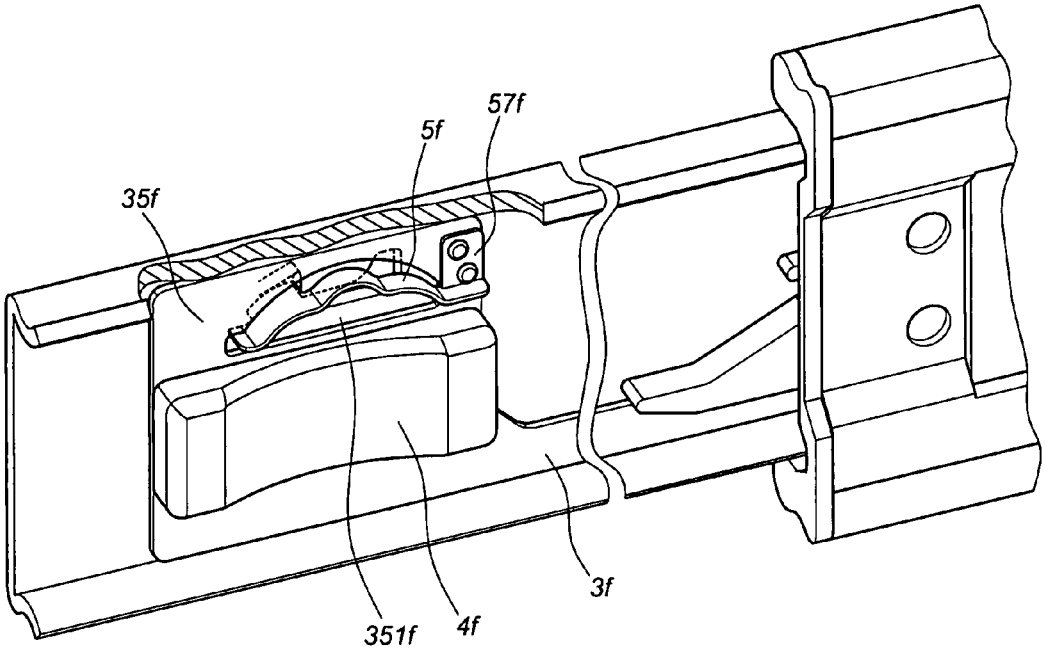
FIG. 19 is a schematic view showing a construction of a seventh preferred embodiment of the present invention.

All those preferred embodiments given above are designed with the operation button (4) having been provided with the locating member (5). However, the operation button (4) is incorporated with the releasing member (3); therefore, having the locating member (5) to be disposed on the releasing member (3) is also a model that can be easily derived from the present invention. In a seventh preferred embodiment as illustrated in FIG. 19, an operation button (4*f*) is incorporated to a handle portion (35*f*) on one end of a releasing member (3*f*) having a larger area; and a locating member (5*f*) has one end provided with an extension plate (57*f*) to be fixed to the handle portion (35*f*). The operation button (4*f*) made in a smaller block is connected to the handle portion (35*f*) of the releasing member (3*f*) and receives the locating member (5*f*) in a space on one side of the operation button (4*f*). The handle portion (35*f*) is provided with a channel (351*f*) to allow penetration and placement by the locating member (5*f*). Furthermore, if the releasing member (3*f*) is provided with a longer handle portion (35*f*) more options are available in selecting the location for mounting the locating member (5*f*).

What is claimed is:

1. A locating structure for a slide assembly, comprising:

a first track having a locating tab at a front end thereof;

a second track inserted and connected onto the first track to slide thereon, the second track being provided with a locating portion;

a releasing member mounted to an inner side of the second track and having one end provided with an operation button, the operation button having one side formed with an indentation;

a locating member, the locating member being resilient and having a fixed end connected to one side of the indentation of the operation button and extending to the indentation, the locating member having a propped portion and a plunged portion and providing resilience for the propped portion to hold against the locating portion of the second track; and a joint channel provided on the indention of the operation button, and the locating member having the fixed end inserted into the joint channel of the operation button;

wherein, when the plunged portion makes contact with the locating tab of the first track, the plunged portion is compressed by the locating tab thereby driving the propped portion to disengage from the locating portion with the movement of the second track thereby allowing the second track to be retracted into the first track.

2. The locating structure for a slide assembly as claimed in claim 1, wherein the locating portion of the second track is disposed in a slot of the second track; and the locating portion has at least one resisting surface.

3. A locating structure for a slide assembly, comprising:

a first track;

a second track inserted and connected onto the first track to slide thereon, the second track being provided with a locating portion;

a releasing member mounted to an inner side of the second track and having one end provided with an operation button, the operation button having an indentation formed on one side thereof; and a locating member disposed in the indentation on the one side of the operation button, the locating member having a propped portion and a plunged portion and providing resilience for the propped portion to hold against the locating portion of the second track, the locating member being resilient and provided with a fixed end; a joint channel being provided on one side of the indention of the operation button; and the locating member having the fixed end to be inserted into the joint channel of the operation button to extend to the indention.

* * * * *